US008893402B2

(12) United States Patent
Hamman et al.

(10) Patent No.: US 8,893,402 B2
(45) Date of Patent: Nov. 25, 2014

(54) METHOD FOR CONTROLLING A PROTECTIVE GAS ATMOSPHERE IN A PROTECTIVE GAS CHAMBER FOR THE TREATMENT OF A METAL STRIP

(75) Inventors: Martin Hamman, Palaiseau (FR); Jerome Vallee, Presles-en-Brie (FR)

(73) Assignee: Andritz Technology and Asset Management GmbH (AT)

( * ) Notice: Subject to any disclaimer, the term of this patent is extended or adjusted under 35 U.S.C. 154(b) by 0 days.

(21) Appl. No.: 13/982,348

(22) PCT Filed: Jan. 30, 2012

(86) PCT No.: PCT/AT2012/000013

§ 371 (c)(1),
(2), (4) Date: Aug. 2, 2013

(87) PCT Pub. No.: WO2012/103563

PCT Pub. Date: Aug. 9, 2012

(65) Prior Publication Data

US 2013/0305559 A1 Nov. 21, 2013

(30) Foreign Application Priority Data

Feb. 4, 2011 (AT) ..... A 152/2011

(51) Int. Cl.

| | |
|---|---|
| ***F26B 21/00*** | (2006.01) |
| ***F27B 9/40*** | (2006.01) |
| ***C21D 9/56*** | (2006.01) |
| ***F27B 9/28*** | (2006.01) |
| *C21D 1/74* | (2006.01) |

(52) U.S. Cl.

CPC ..... *F26B 21/003* (2013.01); *F27B 9/40* (2013.01); *C21D 9/565* (2013.01); *C21D 9/561* (2013.01); *F27B 9/28* (2013.01); *C21D 1/74* (2013.01)

USPC ..... 34/487; 34/497; 110/193; 432/77; 266/111; 148/604; 148/661

(58) Field of Classification Search

USPC ..... 34/380, 381, 407, 487, 497, 526; 110/193; 236/15 R, 49.3; 219/645; 432/59, 60, 64, 77; 266/777, 262, 249; 148/661, 604

See application file for complete search history.

(56) References Cited

U.S. PATENT DOCUMENTS 4,026,787 A * 5/1977 Kuehnle ..... 204/298.24
4,704,167 A * 11/1987 Ichida et al. ..... 148/661

(Continued)

FOREIGN PATENT DOCUMENTS

| | | | |
|---|---|---|---|
| JP | 083652 | | 1/1996 |
| JP | 2012 112168 | * | 6/2012 |
| WO | 2008000945 | | 1/2008 |

OTHER PUBLICATIONS

International Search Report for PCT/AT2012/000013, English translation attached to original, Both completed by the European Patent Office on May 24, 2012, All together 5 Pages.

*Primary Examiner* — Steve M Gravini
(74) *Attorney, Agent, or Firm* — Brooks Kushman P.C.

(57) ABSTRACT

A method for controlling the atmosphere in a protective gas chamber for the continuous treatment of metal strips. A metal strip is guided into and out of the protective gas chamber via locks. At least one lock has at least two sealing elements for the metal strip which runs through it, with the result that a sealed chamber is formed between the two sealing elements. The gas pressure (P2, PD) is measured in the protective gas chamber and in the sealed chamber of the lock and the pressure (PD) in the sealed chamber is regulated, to be precise in such a way that, during operation, the differential pressure between the protective gas chamber and the sealed chamber is kept as far as possible to an optimum value.

8 Claims, 3 Drawing Sheets

(56) References Cited

U.S. PATENT DOCUMENTS

| | | | | |
|---|---|---|---|---|
| 4,896,813 | A * | 1/1990 | Saijo et al. | 228/116 |
| 4,966,632 | A * | 10/1990 | Ecalle et al. | 148/712 |
| 5,364,080 | A * | 11/1994 | Kraemer et al. | 266/262 |
| 5,453,127 | A * | 9/1995 | Flinchum et al. | 118/63 |
| 6,464,808 | B2 * | 10/2002 | Pasquinet et al. | 148/661 |
| 6,608,290 | B1 * | 8/2003 | Robinson | 219/645 |
| 2009/0158975 | A1 | 6/2009 | Cluzel et al. | |
| 2009/0315228 | A1 * | 12/2009 | Pasquinet et al. | 266/44 |
| 2011/0266725 | A1 * | 11/2011 | Mehrain et al. | 266/44 |
| 2011/0270433 | A1 * | 11/2011 | Claveroulas et al. | 700/110 |
| 2013/0305559 | A1 * | 11/2013 | Hamman et al. | 34/487 |
| 2014/0048494 | A1 * | 2/2014 | Simmons, Jr. | 210/748.12 |

* cited by examiner

METHOD FOR CONTROLLING A PROTECTIVE GAS ATMOSPHERE IN A PROTECTIVE GAS CHAMBER FOR THE TREATMENT OF A METAL STRIP

CROSS-REFERENCE TO RELATED APPLICATION

This application is the U.S. national phase of PCT Application No. PCT/AT2012/000013 filed on Jan. 30, 2012, which claims priority to AT Patent Application No. A 152/2011 filed on Feb. 4, 2011, the disclosures of which are incorporated in their entirety by reference herein.

The subject matter of this invention is formed by a method for controlling the atmosphere in a protective gas chamber for the continuous treatment of metal strips, the metal strip being guided into and out of the protective gas chamber by way of locks and at least one of the locks having two or more sealing elements for the metal strip running through, with the result that at least one sealing chamber forms between the sealing elements.

In continuously operating heat treatment furnaces for flat material, the strip is protected from oxidation by using a reducing atmosphere of a nitrogen-hydrogen mixture. Usually, the hydrogen content in the furnace as a whole is kept below 5%.

However, the steel industry is now also increasingly demanding furnace installations that can be operated with two different protective gas atmospheres. For example, in the production of high-strength steel products, a high hydrogen content (15 to 80% H2) is required in the rapid-cooling area (jet cooling section) and a low hydrogen content (<5% H2) is required in the remaining area of the furnace.

In the production of electric steel, a high hydrogen content (50 to 100%) is required in the heating-up, immersion and slow-cooling areas and a moderate hydrogen content (0 to 70% H2) is required in the remaining area of the furnace.

These individual areas of the furnace must be separated from one another by corresponding locks, to be precise in such a way that the metal strip to be treated can run through the individual areas of the furnace with the respective gas atmospheres without too much gas being able to escape through the locks as it does so.

Furthermore, the furnace must be sealed from the surroundings and from further items of equipment by corresponding locks.

The gas flow between different furnace chambers or between one furnace chamber and the surroundings is caused by the following factors:

a.) Inequality of the atmospheric gas flows (inlet/outlet): the amount of gas injected into a certain chamber does not correspond to the amount of gas removed from the same chamber, for which reason the difference flows into the secondary chamber or into the open.

b.) The effect of convection caused by the temperature differences between two chambers (in vertical furnaces): the lightest (hottest) gas flows upward and the heaviest (coldest) gas flows downward, whereby a circulation of atmospheric gas is created in the chambers.

c.) Expansion or contraction of the atmospheric gas as a result of temperature fluctuations in the gas: the temperature fluctuations are caused by the process itself (changing of the furnace temperature, changing of the operating rate of the line, switching on/off of a circulating fan, etc. . . . ) and are unavoidable.

d.) Strip movement: because of the viscosity of the gas, the gas flows into the vicinity of the strip, even in the strip running direction. Therefore, a certain amount of gas is entrained with the strip from one chamber into the next.

At present, two different types of lock are primarily used. On the one hand, single seals are used, formed by a pair of metallic sealing rollers, or a pair of sealing flaps, or a combination of a sealing flap and a sealing roller. The metal strip is then guided into the furnace through the roller/flap gap.

On the other hand, double seals with nitrogen injection are used. These comprise a double pair of metallic sealing rollers or a double pair of flaps, or a double sealing flap/sealing roller device or a combination of two aforementioned sealing devices, nitrogen being injected into the space between the two sealing devices. The nitrogen is thereby introduced at a fixed flow rate or a flow rate that can be adjusted by the operator. No automatic regulation of the flow rate in relation to the process parameters is provided.

Such sealing locks are used for example in continuous annealing lines and in continuous galvanizing lines, in order to achieve a separation between the furnace atmosphere and the outside area (entry seals or discharge nozzle seal) and between two different combustion chambers. In this case, for example, one combustion chamber may be heated by direct firing and the second combustion chamber heated by means of radiant tubes.

These seals produce satisfactory results if a gas flow through the lock in one particular direction must be avoided, but a relatively high gas flow in the opposite direction is allowed.

For example, the flowing of combustion products from a furnace with direct firing into a furnace heated by radiant tubes is prohibited, but relatively great amounts of gas may flow through in the opposite direction. Similarly, an outflow of waste gases from the directly fired furnace into the open is prohibited, but a certain inflow of air from the surroundings into the furnace is allowed. In furnace chambers fired with radiant tubes, the entry of air should be avoided, while it is allowed that a certain amount of protective gas escapes from the furnace into the surroundings. The same applies in the area of the blowpipe when the zinc pot is removed.

Typically, the gas flow between two furnace chambers through conventional locks in one direction is zero and in the opposite direction is in the range from 200 to 1000 $Nm^3/h$. Such flow rates are only achieved if the pressure in the two furnace chambers can be regulated within a certain tolerance.

If, however, the pressure fluctuates outside this tolerance in one of the two furnace chambers, the lock is no longer effective.

The single seals do not deal satisfactorily with the pressure fluctuations occurring under changing operating conditions. As a result, the chemical composition of the atmospheric gas cannot be precisely regulated, since unavoidable pressure fluctuations in both chambers would bring about an alternating atmospheric gas flow, in one direction or the other.

A conventional double seal with injection of a constant amount of nitrogen is likewise sensitive to the pressure fluctuations in the combustion chambers. The chemical composition of the atmospheric gas in the combustion chambers cannot be precisely regulated since, depending on the pressure conditions, the nitrogen injected flows alternately into one chamber or into the other chamber, or into both chambers.

Consequently, these conventional sealing systems do not sufficiently separate the atmospheric gas and to some extent lead to a considerable increase in the consumption of atmospheric gas.

A conventional double seal that ensures good atmospheric separation is described in WO 2008/000945 A1. However, the weakness of this technology lies in the high consumption of atmospheric gas, which causes higher operating costs and even precludes application in furnaces for silicon steel.

In the case of furnaces for silicon steel, the entry seal usually consists of a pair of sealing rollers of metal and a series of curtains. The atmospheric separation within the furnace normally takes place by a single opening in a fireclay wall and the exit seal consists either of soft-covered rollers (Hypalon or elastomer) or of refractory fibers.

Such a sealing system has the disadvantage that, in the case of the entry seal, there is a constant leakage of hydrogen-containing atmospheric gas through the roller gap (1 to 2 mm). This gas burns constantly. The inner seal leads to a poor separating performance on account of the size of the opening (100 to 150 mm) and the exit seal cannot be used at high temperature>200° C.

The aim of the invention is to offer a regulating method for regulating the gas flow through the lock that ensures a high degree of atmospheric gas separation and lowers the consumption of atmospheric gas.

This object is achieved by a regulating method in which the gas pressure in at least one protective gas chamber and in the sealing chamber of the lock is measured and in which the pressure in the sealing chamber is regulated, to be precise such that during operation the differential pressure ($\Delta P_{seal}$) between the protective gas chamber and the sealing chamber is kept to the greatest extent above or below a predetermined value for the critical differential pressure ($\Delta P_{seal,\,k}$).

The critical differential pressure ($\Delta P_{seal,\,k}$) is in this case that value at which the gas flow between the protective gas chamber and the lock is reversed. Therefore, at the critical differential pressure ($\Delta P_{seal,\,k}$), no gas flow should take place between the protective gas chamber and the sealing chamber. However, the critical differential pressure ($\Delta P_{seal,\,k}$) does not necessarily have to have the value zero; although at this value the pressures in the protective gas chamber and in the sealing chamber would be the same, there may nevertheless be a gas flow between these chambers, since the metal strip transports a certain amount of gas along with it on its surface.

On account of the small volume of the sealing chamber, the pressure in this chamber can be quickly and precisely regulated by injecting or discharging a small amount of gas.

On account of the precise pressure regulation in the sealing chamber, the differential pressure ($\Delta P_{seal}$) can preferably be kept close to the value for the critical differential pressure ($\Delta P_{seal,\,k}$) As a result, the flow rate of the atmospheric gas into or out of the protective gas chamber is reduced to a minimum.

It is advantageous if the set differential pressure ($\Delta P_{seal}$) is kept at a constant margin from the critical differential pressure ($\Delta P_{seal,\,k}$), although the margin should be kept as small as possible.

The critical differential pressure ($\Delta P_{seal,\,k}$) typically lies between 0 and 100 Pa, and the margin between the set differential pressure and the critical differential pressure typically lies between 5 and 20 Pa.

This method allows a good performance to be achieved in separating the atmospheres between protective gas chambers with relatively low consumption of the protective gas (from 10 to 200 $Nm^3/h$). It also allows a good separation of the protective gas chamber from the surroundings.

The pressure in the sealing chamber may be regulated either by way of a regulating valve and a gas feed or by way of a regulating valve and a negative pressure source. The negative pressure source may be, for example, an exhaust fan, a flue or the surroundings.

The method according to the invention is also very well suited for NGO silicon steel lines. In the case of such lines, an atmosphere with 95% $H_2$ in one chamber must be separated from an atmosphere with 10% $H_2$ in a second chamber, while the consumption of hydrogen by the lock should be less than 50 $Nm^3/h$.

The method is also well suited for rapid cooling in continuous annealing lines or galvanizing lines for C steel. Here, an atmosphere with 30-80% $H_2$ must be separated from an atmosphere with 5% $H_2$, while the consumption of hydrogen by the lock should be less than 100 $Nm^3/h$.

With the method according to the invention, in galvanizing lines the transfer of zinc dust from the blowpipe into the furnace can also be minimized, to be precise in particular in the case of lines for the zinc-aluminum coating of metal strips.

In one embodiment of the invention, the lock according to the invention is arranged between the protective gas chamber and a further treatment chamber with a protective gas atmosphere.

The metal strip may in this case either be guided first through the further treatment chamber and then through the protective gas chamber, or it may be guided first through the protective gas chamber and then through the further treatment chamber.

It is advantageous if the predetermined value for the critical differential pressure ($\Delta P_{seal,\,k}$) is calculated by way of a mathematical model, which preferably takes account of the speed of the metal strip, the gap opening of the two sealing elements, the properties of the protective gas and the thickness of the metal strip.

It is advisable if the optimum gap opening of the two sealing elements is calculated on the basis of the properties of the protective gas and the thickness of the metal strip.

The method according to the invention is described below on the basis of drawings, in which.

Figure 1:
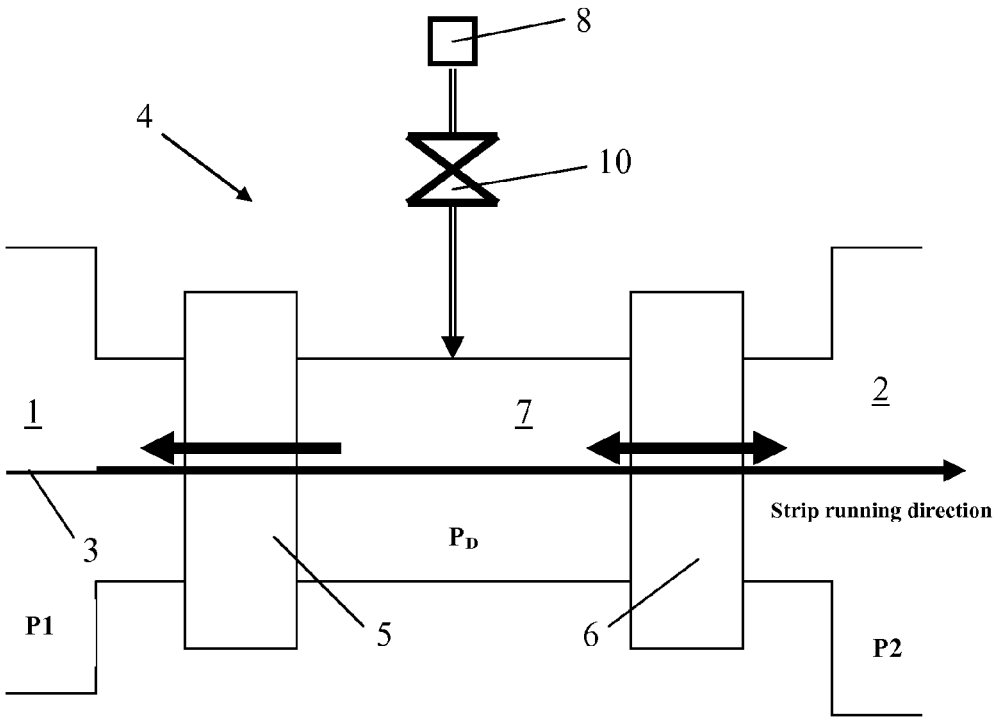
FIG. 1 shows a first variant of the invention with a gas feeding system for the sealing chamber.

The regulating method is now described on the basis of a lock 4 between a secondary chamber 1 (further treatment chamber 1) and a protective gas chamber 2. The same principle also applies if the lock 4 is located between a protective gas chamber 2 and the area outside, the area outside being regarded as a secondary chamber 1 filled with constant air pressure.

The pressures P and flow rates F that are represented in the figures are defined as follows:

- P1=pressure in the secondary chamber 1 or the area outside 1
- P2=pressure in the protective chamber 2
- $P_D$=pressure in the sealing chamber 7
- $\Delta P_{chamber}$=P2−P1 (=differential pressure between the protective gas chamber 2 and the secondary chamber 1 or differential pressure between the protective gas chamber 2 and the area outside)
- $\Delta P_{seal}$=$P_D$−P2 (=differential pressure between the sealing chamber 7 and the protective gas chamber 2)

$\Delta P_{seal,k}$=critical differential pressure between the sealing chamber 7 and the protective gas chamber 2=that differential pressure ($P_D$–P2) at which the gas flow direction F2 between the protective gas chamber 2 and the sealing chamber 7 changes (is reversed)

F2=flow rate of the atmospheric gas between the protective gas chamber 2 and the sealing chamber 7

F1=flow rate of the atmospheric gas between the sealing chamber 7 and the secondary chamber 1

$F_D$=flow rate of the atmospheric gas injected into the sealing chamber 7 or discharged In FIG. 1, the secondary chamber 1 and the protective gas chamber 2 are shown with the lock 4 lying in between. The lock 4 consists of a first sealing element 5 and a second sealing element 6, between which there is the sealing chamber 7.

The compositions of the protective gas ($N_2$ content, $H_2$ content, dew point) in the two chambers 1 and 2 and the respective pressure P1 and P2 in the chambers 1 and 2 are regulated by two separate mixing stations. This regulation by the mixing stations is performed on the basis of conventional controls. In other words, the chemical composition of the protective gas atmosphere is regulated by adaptation of the $N_2$, $H_2$, and $H_2O$ content in the atmospheric gas injected and the pressure regulation takes place by adaptation of the flow rate of the atmospheric gas injected into the chambers 1, 2. The atmospheric gas is discharged from the chambers 1, 2 through openings that have a fixed setting or are adjustable. The sealing elements 5 and 6 may be respectively formed by two rollers or two flaps or one roller and one flap, between which the metal strip 3 is guided. The gap between the rollers or flaps is defined while taking account of the properties (chemical composition, temperature) of the atmospheric gas in the chamber 1 (2) and the thickness of the strip. It may have a fixed setting or be adjustable, adepending on the range of fluctuation of the properties of the atmospheric gas and the strip dimensions. If the gap is adjustable, it is preset according to the thickness of the strip, chemical composition of the atmospheric gas and according to the temperature of the strip.

The size of the opening in the sealing elements 5 and 6 is dependent on the gap, on the strip dimensions (width, thickness), and on the remaining structurally necessitated openings. In order to achieve a good sealing performance, the opening in the sealing elements 5, 6 must be correspondingly small.

The pressure $P_D$ in the sealing chamber 7 between the two sealing elements 5, 6 may be adjusted by the regulating valve 10. The regulating valve 10 regulates the flow rate of the gas injected into the sealing chamber 7 or discharged. In FIG. 1, the regulating valve 10 is connected to a gas feed 8; therefore, the pressure in the sealing chamber 7 is regulated by way of regulating the gas feed into the sealing chamber 7.

The chamber pressures P1 and P2 are regulated by two independent pressure regulating circuits. For regulating the lock 4, the pressure $P_D$ in the sealing chamber 7 and in the protective gas chamber 2 is measured. The pressure $P_D$ is kept close to the pressure P2 in the protective gas chamber 2.

In the example that is represented in FIG. 1, $\Delta P_{seal}$ is fixed at $P_D$–P2. The pressure $P_D$ is thus regulated such that $\Delta P_{seal}$ remains constant to the greatest extent, even if the pressure P2 varies.

With the device according to FIG. 1 it is possible for example to pursue two pressure regulating strategies for the lock 4:

1.) Contamination of the protective gas chamber 2 is to be avoided:

The aim is to avoid atmospheric gas entering the protective gas chamber 2 through the lock 4, in order that the chemical composition in this chamber can be regulated. However, the aim is also to minimize the escape of atmospheric gas from the protective gas chamber 2, in order that the gas consumption of the protective gas chamber 2 can be minimized.

Figure 2:
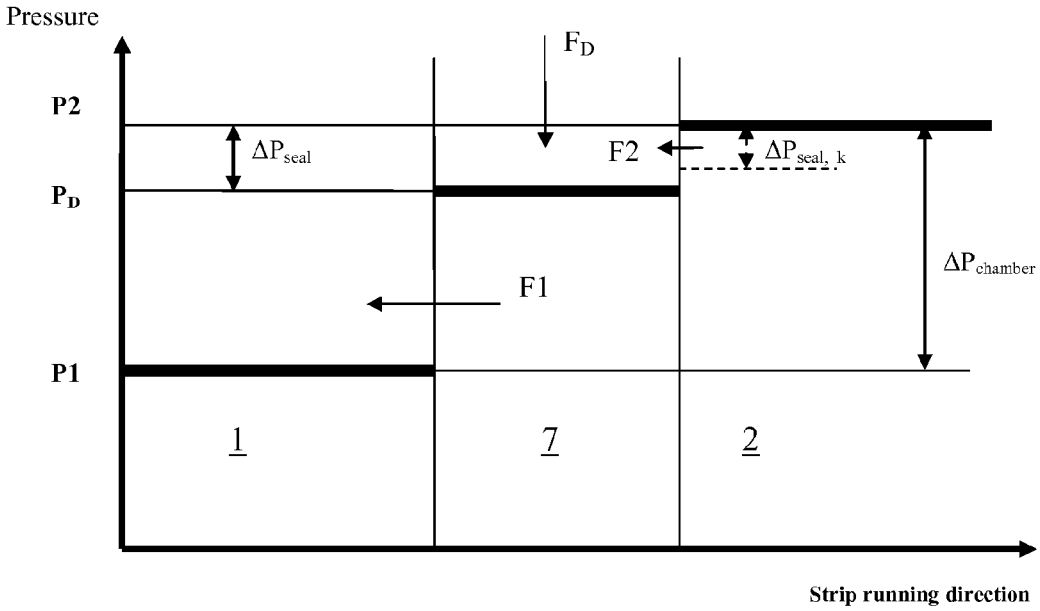
FIG. 2 shows the pressure variation in the chambers for a regulating method for the first variant according to FIG. 1.

FIG. 2 shows the pressure variation in the chambers 1, 2, and 7. The pressure P1 in the secondary chamber 1 is set lower than the pressure P2 in the protective gas chamber 2, while the pressure in the sealing chamber $P_D$ is set between P1 and P2, but only slightly lower than the pressure P2 in the protective gas chamber 2.

If the pressure P2 in the protective gas chamber 2 changes, the pressure $P_D$ is adjusted correspondingly, in order to keep the pressure differential $\Delta P_{seal}=P_D-P2$ as constant as possible. $\Delta P_{seal}$ is negative here. The flow rate F2 of the is atmospheric gas into and out of the protective gas chamber 2 is regulated by way of the differential pressure $\Delta P_{seal}$.

If $\Delta P_{seal}$ is kept below the value for the critical differential pressure $\Delta P_{seal,k}$, no atmospheric gas enters the protective gas chamber 2. Regulating $\Delta P_{seal}$ to be as seal to close as possible to the value $\Delta P_{seal,k}$ allows the flow rate F2 of the atmospheric gas escaping from the protective gas chamber 2 to be minimized. The flow rate $F_D$ is determined by the pressure regulating circuit for the regulation of $\Delta P_{seal}$, while the flow rate F1 is obtained from $F2+F_D$.

This regulating strategy is suitable for applications in which the chemical composition in the protective gas chamber 2 must be regulated optimally. This strategy can for example be used well in continuous annealing lines (CAL) and in continuous galvanizing lines (CGL) with a high $H_2$ content. The chamber with the high $H_2$ content thereby forms the previously mentioned protective gas chamber 2. This regulating strategy is also suitable for the heating-up, immersion and radiant-tube cooling chambers with a high $H_2$ content in the case of electric-steel heat treatment. Here, too, the chamber with the high $H_2$ content forms the chamber 2.

2.) Leakage of protective gas from the protective gas chamber 2 is to be avoided:

The aim is to avoid leakage of atmospheric gas from the protective gas chamber 2, in order that the secondary chamber 1 is not contaminated by a component from the protective gas chamber 2. However, the entry of atmospheric gas into the protective gas chamber 2 is also to be minimized.

Figure 3:
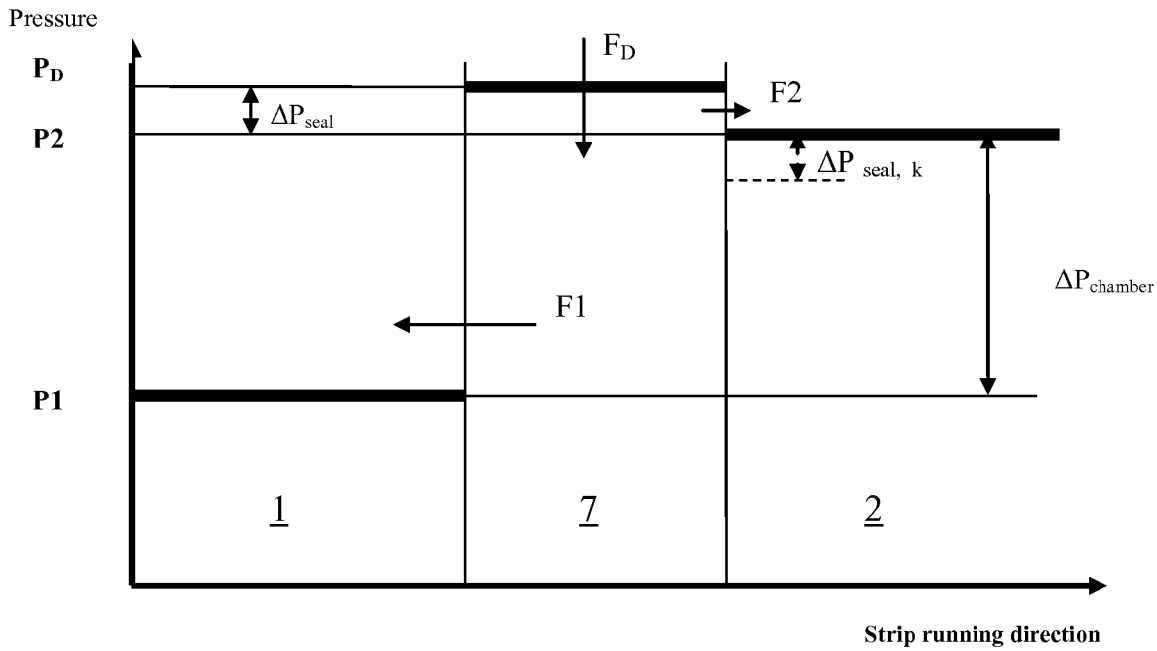
FIG. 3 shows the pressure variation in the chambers for a further regulating method for the first variant according to FIG. 1.

FIG. 3 shows the pressure variation in the chambers 1, 2 and 7, the pressure P1 in the secondary chamber 1 being set such that it is lower than the pressure P2 in the protective gas chamber 2. The pressure $P_D$ in the sealing chamber 7 is set higher than P1 and P2, but only slightly higher than the pressure P2 in the protective gas chamber 2.

If the pressure P2 in the protective gas chamber 2 changes, the pressure $P_D$ is adapted correspondingly, in order to keep the pressure differential $\Delta P_{seal}=P_D-P2$ as constant as possible. $\Delta P_{seal}$ is positive here. The flow rate F2 of the atmospheric gas into or out of the chamber 2 is regulated by way of the $\Delta P_{seal}$ value.

If $\Delta P_{seal}$ is kept above the value for the (calculated) critical differential pressure $\Delta P_{seal,k}$, no atmospheric pressure escapes from the protective gas chamber 2. Regulating $\Delta P_{seal}$ to be as close as possible to the value $\Delta P_{seal,k}$ allows the flow rate F2 of the atmospheric gas flowing into the chamber 2 to be minimized. The flow rate $F_D$ is determined by the pressure regulating circuit for the regulation of $\Delta P_{seal}$, while the flow rate F1 is obtained from $F_D$–F2.

This regulating strategy is suitable for applications in which no atmospheric gas may escape from the protective gas chamber 2 and in which the protective gas chamber 2 must not be contaminated by atmospheric gas from the secondary chamber 1. It may be used, for example, for regulating the input or output lock in FAL, CAL and CGL. The furnace thereby forms the protective gas chamber 2. It is similarly suitable for lock control in zinc-aluminum coating processes (the blowpipe thereby forms the protective gas chamber 2) or for processes with chambers with different dew points. The chamber with the high dew point then forms the protective gas chamber 2.

Figure 4:
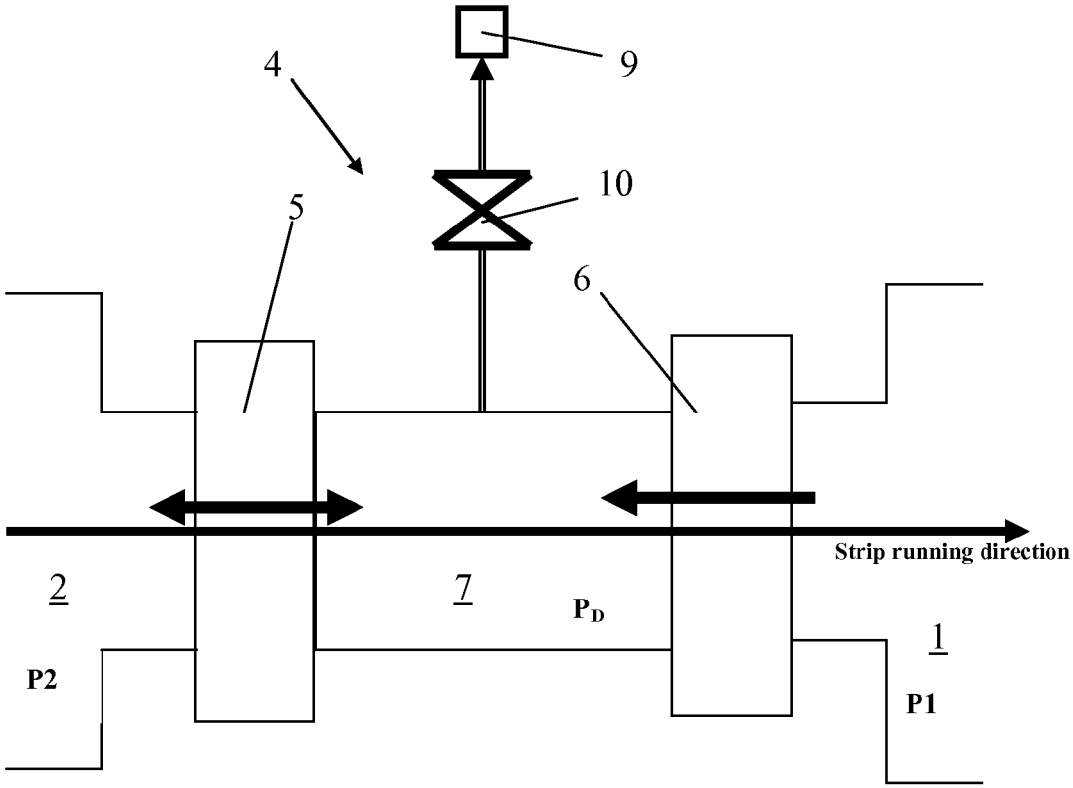
FIG. 4 shows a second variant of the invention in which the sealing chamber is connected to a negative pressure system.

In FIG. 4 there is then shown a variant in which the sealing chamber 7 is connected to a negative pressure source 9. Therefore, by contrast with FIG. 1, in FIG. 4 the regulation of the gas pressure in the sealing chamber 7 takes place by way of a gas discharge $F_D$.

The adjustment of the flow rate $F_D$ of the gas flowing out of the sealing chamber 7 has the effect that the pressure $P_D$ in the sealing chamber 7 is continuously adapted. The flow rate $F_D$ of the outflowing gas is regulated by way of a control valve 10, the negative pressure being produced by means of an exhaust fan or by the natural draw of the flue.

In the example that is represented in FIG. 4, the metal strip runs out from the protective gas chamber 2 into the lock 4. However, the regulating strategy is not dependent on the running direction of the strip. The pressure in the sealing chamber $P_D$ is regulated such that $\Delta P_{seal}$ remains as constant as possible, even if the pressure P2 in the protective gas chamber 2 varies.

With the device according to FIG. 4 it is possible, for example, to pursue two different pressure regulating strategies:

1.) Leakage from the protective gas chamber 2 is to be avoided:

The aim is to avoid leakage of atmospheric gas from the protective gas chamber 2, in order that the secondary chamber 1 is not contaminated by a component from the protective gas chamber 2, but also to minimize the entry of atmospheric gas into the protective gas chamber 2, in order that the chemical composition in the protective gas chamber 2 can be regulated.

Figure 5:
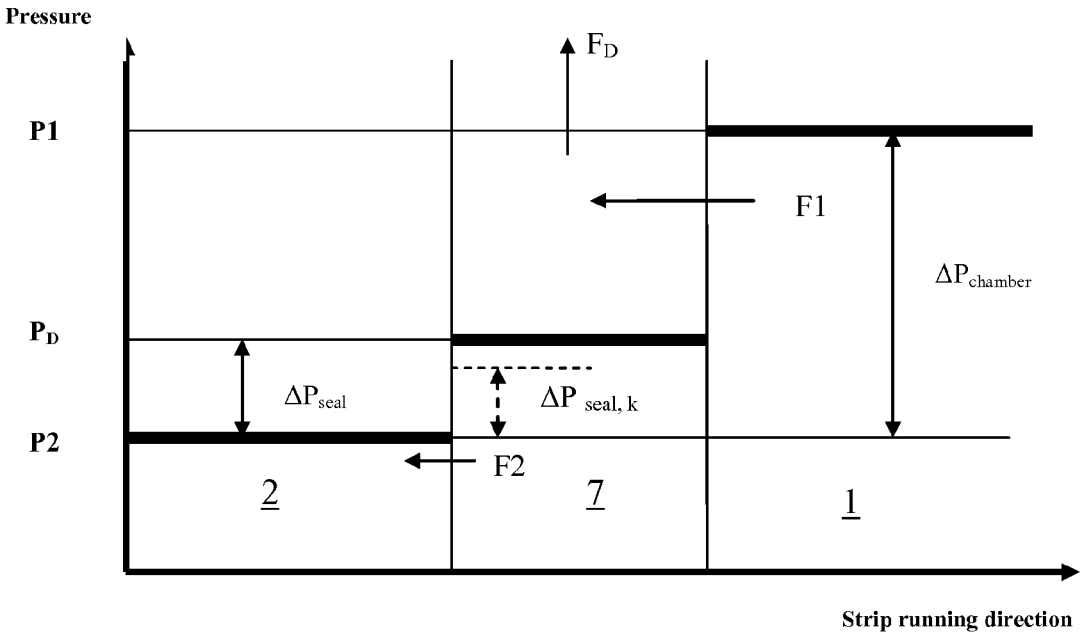
FIG. 5 shows the pressure variation in the chambers for a regulating method for the second variant according to FIG. 4.

FIG. 5 shows the pressure variation in the chambers 1, 2 and 7 for a lock 4 according to FIG. 4. The pressure P1 in the secondary chamber 1 is set such that it is higher than the pressure P2 in the protective gas chamber 2. The pressure $P_D$ in the sealing chamber 7 is set between P1 and P2, but only slightly higher than the pressure P2 in the protective gas chamber 2.

If the pressure P2 in the protective gas chamber 2 changes, the pressure $P_D$ is adapted correspondingly, in order to keep the pressure differential $\Delta P_{seal}=P_D-P2$ as constant as possible. $\Delta P_{seal}$ is therefore positive here. The flow rate F2 of the atmospheric gas into or out of the chamber 2 is regulated by way of the $\Delta P_{seal}$ value.

If $\Delta P_{seal}$ is kept above the critical value for the differential pressure $\Delta P_{seal\ k}$, no atmospheric gas escapes from the protective gas chamber 2. If the variable $\Delta P_{seal}$ is regulated to be as close as possible to $\Delta P_{seal,\ k}$, the flow rate F2 of the atmospheric gas flowing into the protective gas chamber 2 can be minimized. The flow rate $F_D$ is determined by the pressure regulating circuit for the regulation of $\Delta P_{seal}$, while the flow rate F1 is obtained from $F2+F_D$.

This regulating strategy is suitable for lines in which no atmospheric gas may escape from the protective gas chamber 2 and in which the inflow into the protective gas chamber 2 must be minimized. The applications are the same as the applications for FIG. 3, but for the case where the pressure P2 in the protective gas chamber 2 is lower than in the secondary chamber 1.

2.) Contamination of the protective gas chamber 2 is to be avoided:

The aim is to avoid entry of atmospheric gas into the protective gas chamber 2 (in order that the chemical composition in the protective gas chamber 2 can be regulated), but also to minimize the escape of atmospheric gas from the protective gas chamber 2 (in order that the gas consumption of the protective gas chamber 2 can be minimized).

Figure 6:
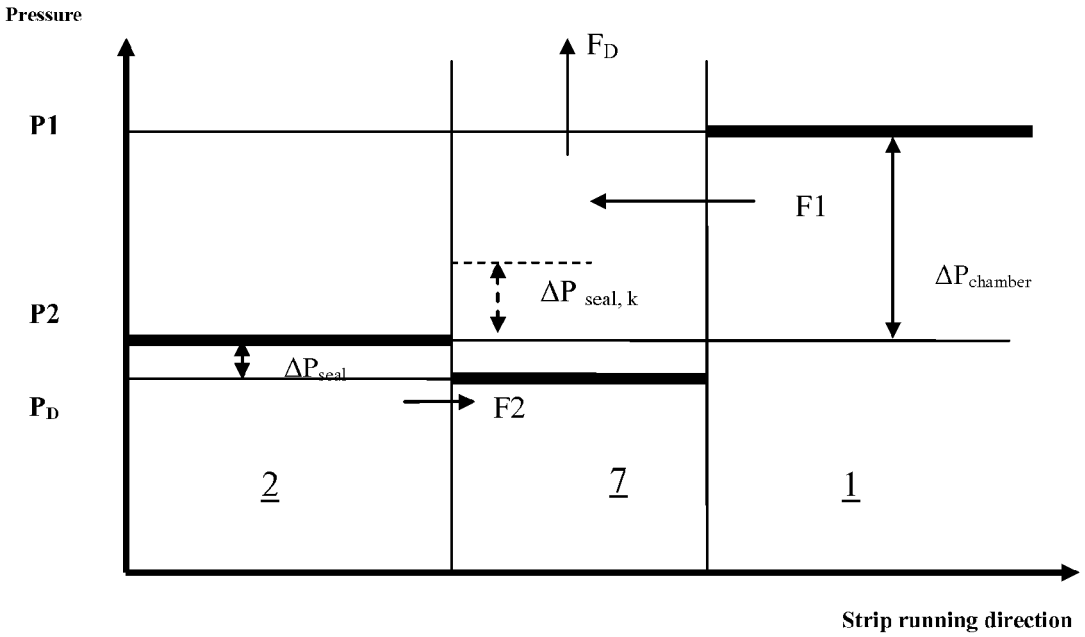
FIG. 6 shows the pressure variation in the chambers for a further regulating method for the second variant according to FIG. 4.

FIG. 6 shows the pressure variation in the chambers 1, 2 and 7. The pressure P1 in the secondary chamber 1 is set higher than the pressure P2 in the protective gas chamber 2, while the pressure $P_D$ in sealing chamber 7 is set lower than P1 and P2, but only slightly lower than the pressure P2 in the protective gas chamber 2.

If the pressure P2 changes, the pressure $P_D$ is adjusted correspondingly, in order to keep the pressure differential $\Delta P_{seal}=P_D-P2$ as constant as possible. $\Delta P_{seal}$ is negative here. The flow rate F2 of the atmospheric gas into or out of the chamber 2 is regulated by way of the $\Delta P_{seal}$ value.

If $\Delta P_{seal}$ is kept below the value for the critical differential pressure $\Delta P_{seal,\ k}$, no atmospheric gas enters the chamber 2. If the variable $\Delta P_{seal}$ is regulated to be as close as possible to the value $\Delta P_{seal,\ k}$, the flow rate of the atmospheric gas F2 escaping from the chamber 2 can be minimized. The flow rate $F_D$ is determined by the pressure regulating circuit for the regulation of $\Delta P_{seal}$, while the flow rate F1 is obtained from $F_D+F1$.

This regulating strategy is well suited if the chemical composition in the protective gas chamber 2 must be regulated optimally, but the outflow of atmospheric gas from the protective gas chamber 2 must be minimized or if the chemical composition in both chambers 1, 2 must be regulated optimally.

Since the amount of leakage of the gas through a sealing element (5, 6) cannot be measured, a mathematical model has been developed to calculate it.

The model makes it possible to calculate the differential pressure $\Delta P_{seal}$ between the protective gas chamber 2 and the sealing chamber 7 ($\Delta P_{seal}=P_D-P2$) in dependence on the following parameters:

- Physical properties of the atmospheric gas (such as for example weight per unit volume and viscosity): these properties are calculated from the chemical composition (percentage of $H_2$ and $N_2$, etc.) and the temperature of the atmospheric gas flowing through the sealing elements.
- Open surface area in the sealing elements 5, 6: the open surface area depends on the gap set in the sealing elements and the dimensions of the strip (thickness, width).
- Line speed: the line speed is the speed of the strip being treated.
- Flow of the atmospheric gas $F_D$, F1, F2: the flow F1 or F2 of the atmospheric gas through the sealing elements 5, 6 is regarded as a parameter to be regulated.
- Construction of the lock 4: A number of technologies are available for the construction (flaps, rollers, others . . . ). The mathematical model takes account of the respective technology.

The mathematical model is based on a formula that represents the relationship between the parameters. The calculation requires only little computing effort and can therefore be integrated in furnace control systems.

The mathematical model read as follows:

$$\Delta P_{seal}=f1(\rho,\mu,h,Vs)+f2(\rho,\mu,h,Vg)$$

- $\Delta P_{seal}$=pressure differential between the sealing chamber 7 and the protective gas chamber 2
- $\rho$=weight per unit volume of the atmospheric gas
- $\mu$=dynamic viscosity of the atmospheric gas
- h=geometrical factor
- Vg=flow rate of the atmospheric gas flowing into or out of the sealing chamber
- Vs=line speed=speed of the strip
- f1 and f2 are mathematical formulas that are dependent on the construction of the lock 4 (rollers, flaps) and on the type of gas flow (laminar, turbulent).

The parameters of the mathematical model are adapted by means of computer-controlled simulation software in offline mode.

The model provides the value for the critical differential pressure $\Delta P_{seal,\ k}$ between the sealing chamber 7 and the protective gas chamber 2 that leads to no gas flow between the protective gas chamber 2 and the sealing chamber 7 (Vg=0). This critical value $\Delta P_{seal,k}$ serves as a reference for regulating the pressure in the sealing chamber 7. The setpoint value for the differential pressure $\Delta P_{seal}$ is based on the calculated critical differential pressure $\Delta P_{seal,\ k}$, as described in the examples mentioned above.

If the differential pressure $\Delta P_{seal}$ is higher than this critical value $\Delta P_{seal,\ k}$, the atmospheric gas flows out of the sealing chamber 7 into the protective gas chamber 2. It is important that here, too, the respective signs of the differential pressures $\Delta P_{seal}$ and $\Delta P_{seal,\ k}$ are observed. "Higher" or "above" is synonymous with the expression "further into the positive numerical range".

If the differential pressure $\Delta P_{seal}$ lies below the value for the critical differential pressure $\Delta P_{seal,k}$, the atmospheric gas flows out of the protective gas chamber 2 into the sealing chamber 7.

It should once again be pointed out that the differential pressure $\Delta P_{seal}$ may also be negative (for example in FIG. 2 and FIG. 6). The note that the differential pressure $\Delta P_{seal}$ lies below the value for the critical differential pressure $\Delta P_{seal,k}$ should be understood as meaning that the value for the differential pressure $\Delta P_{seal}$ is further into the negative range than the value for the critical differential pressure $\Delta P_{seal,k}$.

The mathematical model is used on the one hand for calculating the gap to be set of the two sealing elements 5, 6 while taking account of the properties of the atmospheric gas and the thickness of the strip. On the other hand, it is used for calculating the value for the critical differential pressure $\Delta P_{seal,k}$ between the sealing chamber 7 and the protective gas chamber 2. With the aid of the calculated critical differential pressure $\Delta P_{seal,\ k}$, the differential pressure $\Delta P_{seal}$ to be set (setpoint value) is then fixed.

The setting parameters calculated with the mathematical model form the setpoint values for controlling the lock.

The invention claimed is:

1. A method for controlling the protective gas atmosphere in a protective gas chamber for the continuous treatment of metal strips, the metal strip being guided into and out of the protective gas chamber by way of locks and at least one of the locks having two sealing elements for the metal strip running through, with the result that a sealing chamber forms between the two sealing elements, the gas pressure (P2, $P_D$) in the protective gas chamber and in the sealing chamber of the lock being measured and the pressure ($P_D$) in the sealing chamber being regulated, wherein the pressure ($P_D$) in the sealing chamber is regulated such that during operation the differential pressure ($\Delta P_{seal}$) between the protective gas chamber and the sealing chamber is kept to the greatest extent above or below a predetermined value for the critical differential pressure ($\Delta P_{seal,\ k}$), the critical differential pressure ($\Delta P_{seal,\ k}$) being fixed as that value at which the gas flow between the protective gas chamber and the sealing chamber is reversed and the critical value for the differential pressure ($\Delta P_{seal,\ k}$) being calculated by way of a mathematical model, which takes account of the speed of the metal strip, the gap opening of the two sealing elements, the properties of the protective gas and the thickness of the metal strip, and the value set during operation for the differential pressure ($\Delta P_{seal}$) being kept as close as possible to the critical value for the differential pressure ($\Delta P_{seal,\ k}$), with the result that the gas flow (F2) from or into the protective gas chamber is minimized.

2. The method as claimed in claim 1, wherein the pressure ($P_D$) in the sealing chamber is regulated by way of a regulating valve and a gas feed.

3. The method as claimed in claim 1, wherein the pressure ($P_D$) in the sealing chamber is regulated by way of a regulating valve and a negative pressure source.

4. The method as claimed in claim 1, wherein the pressure ($P_D$) in the sealing chamber is regulated by way of two regulating valves, a gas feed and a negative pressure source.

5. The method as claimed in claim 1, wherein the lock is arranged between the protective gas chamber and a further treatment chamber with a protective gas atmosphere.

6. The method as claimed in claim 5, wherein the metal strip is guided first through the further treatment chamber and then through the protective gas chamber.

7. The method as claimed in claim 5, wherein the metal strip is guided first through the protective gas chamber and then through the further treatment chamber.

8. The method as claimed in claim 1, wherein the optimum gap opening of the two sealing elements is calculated on the basis of the properties of the protective gas and the thickness of the metal strip.

* * * * *